US005458194A

United States Patent [19]

Brooks

[11] Patent Number: 5,458,194

[45] Date of Patent: Oct. 17, 1995

[54] SUBSEA INFLATABLE PACKER SYSTEM

[75] Inventor: Robert T. Brooks, Houston, Tex.

[73] Assignee: CTC International Corporation, Houston, Tex.

[21] Appl. No.: 358,703

[22] Filed: Dec. 19, 1994

Related U.S. Application Data

[62] Division of Ser. No. 187,079, Jan. 27, 1994, Pat. No. 5,396,954.

[51] Int. Cl.[6] ..... E21B 33/14

[52] U.S. Cl. ..... 166/285

[58] Field of Search ..... 166/285, 289, 166/290, 350, 368, 386, 387

[56] References Cited

U.S. PATENT DOCUMENTS 4,703,813 11/1987 Sieler ..... 166/285 X 5,348,093 9/1994 Wood et al. ..... 166/285 X

*Primary Examiner*—Michael Powell Buiz

*Attorney, Agent, or Firm*—Donald H. Fidler

[57] ABSTRACT

A subsea packer system for large diameter casings where an inflatable liner is connected in a string of casing and has an inner tubular drillable insert member with a longitudinal bypass passage. A string of tubing with a releasable running tool is connected to a casing well head on the casing for transport into a well bore and has an isolation seal member for closing off inflation ports which extend through the insert member to the inflatable packer. The bore of the insert member is sized to a bore diameter less than the bore diameter of the casing well head and is less than the diameter of the casing.

3 Claims, 3 Drawing Sheets

SUBSEA INFLATABLE PACKER SYSTEM

This is a divisional application Ser. No. 08/187,079 filed on Jan. 27, 1994 now U.S. Pat. No. 5,396,954.

FIELD OF THE INVENTION

The invention relates to inflatable well bore packers and more particularly to inflatable well bore packer systems for use in large diameter casing in underwater or subsea operations.

BACKGROUND OF THE INVENTION

Subsea completions are occurring at ever increasing depths and are utilizing larger diameter casings. One of the problems encountered in subsea completions are subterranean gas and/or water zones which complicate the cementing process for a casing, such gas or water fluids can cause channeling to occur when the annulus about a well casing is cemented. It is, of course, important to that the cement seal off the annulus and to prevent fluid intrusion while the cement sets up in the annulus. One solution is to use an inflatable packer. However, with large diameter casing there is usually a restricted bore. It is difficult to cement the casing and to actuate an inflatable packer on a casing because of both the bore size of the casing and the restricted bore size of some of the wellheads.

THE PRESENT INVENTION

The present invention is for large diameter, subsea well operations where a casing and attached wellhead present a restricted bore opening and it is desired to set the casing where the casing traverses one or more locations which introduce intruding fluids to the well bore.

The operations involve setting a first conductor well head and a conductor pipe in the earth formations below the subsea floor. Next, an integrated assembly consisting of (1) a tubular casing and attached casing wellhead and (2) a tubing string within the casing where the tubing string extends from a running tool to float shoes at the lower end of the casing and extends from the running tool to the drilling rig. The running tool is attached to the casing wellhead. In the casing, at a location selected to be above the location having intrusive fluids, is an inflatable packer. The bore of the inflatable packer is fitted with a tubular drillable insert for providing a smaller bore in the packer. The effective bore in the packer has a bore diameter less than the diameter of the bore of the attached casing wellhead. The tubing or pipe string has an attached tubular seal member located along its length which is sealingly received in the bore of the drillable insert. The seal member has a normally closed valve which isolates the inflatable packer from the bore of the seal member when primary cement slurry is pumped down the tubing string. With the tubing string extending downwardly to the float shoes in the lower end of the casing, the mud in the annulus between the casing and the tubing causes the cement slurry to fill the annulus between the casing and borehole to the wellhead. Upon filling the annulus with primary cement slurry, a packer inflation cement slurry is pumped down the tubing string behind a cementing dart. When the dart reaches the seal member, it opens the normally closed valve to channel inflation cement to the inflatable packer and inflate the packer cement on the inflatable packer. The inflatable packer then effectively isolates the annulus above the intrusion location so that the primary cement above the packer element can set up properly to support the casing.

Before the cement slurry sets up in the annulus, and also inside the tubing workings, the running tool is disengaged from the casing wellhead and the seal member can be retrieved through the restricted bore of the wellhead. Thereafter, the drillable insert can be removed by a underreaming operation. Of course, if the next borehole to be drilled has a diameter smaller than the bore of drillable insert, the insert can be left intact or in place. In either case the inflatable packer can be safely and reliably inflated without undue use of cement in the casing.

DESCRIPTION OF THE INVENTION

In one type of underwater completion, a conductor pipe is attached to a conductor wellhead and is driven into the ocean floor. The conductor pipe is typically 200 to 300 feet in length. For example, in 3000 feet of water, a 36" conductor wellhead with an attached conductor pipe can be utilized as a foundation in the earth formations below the sea floor for receiving a casing where the casing is subsequently cemented in place. The casing is typically 2000 to 3000 feet in length. In this instance, after the conductor pipe and the wellhead are installed, a well bore is drilled for the length of casing desired thru the 36" pipe to the desired depth below the bottom of the conductor pipe.

Figures 1, 2, 3:
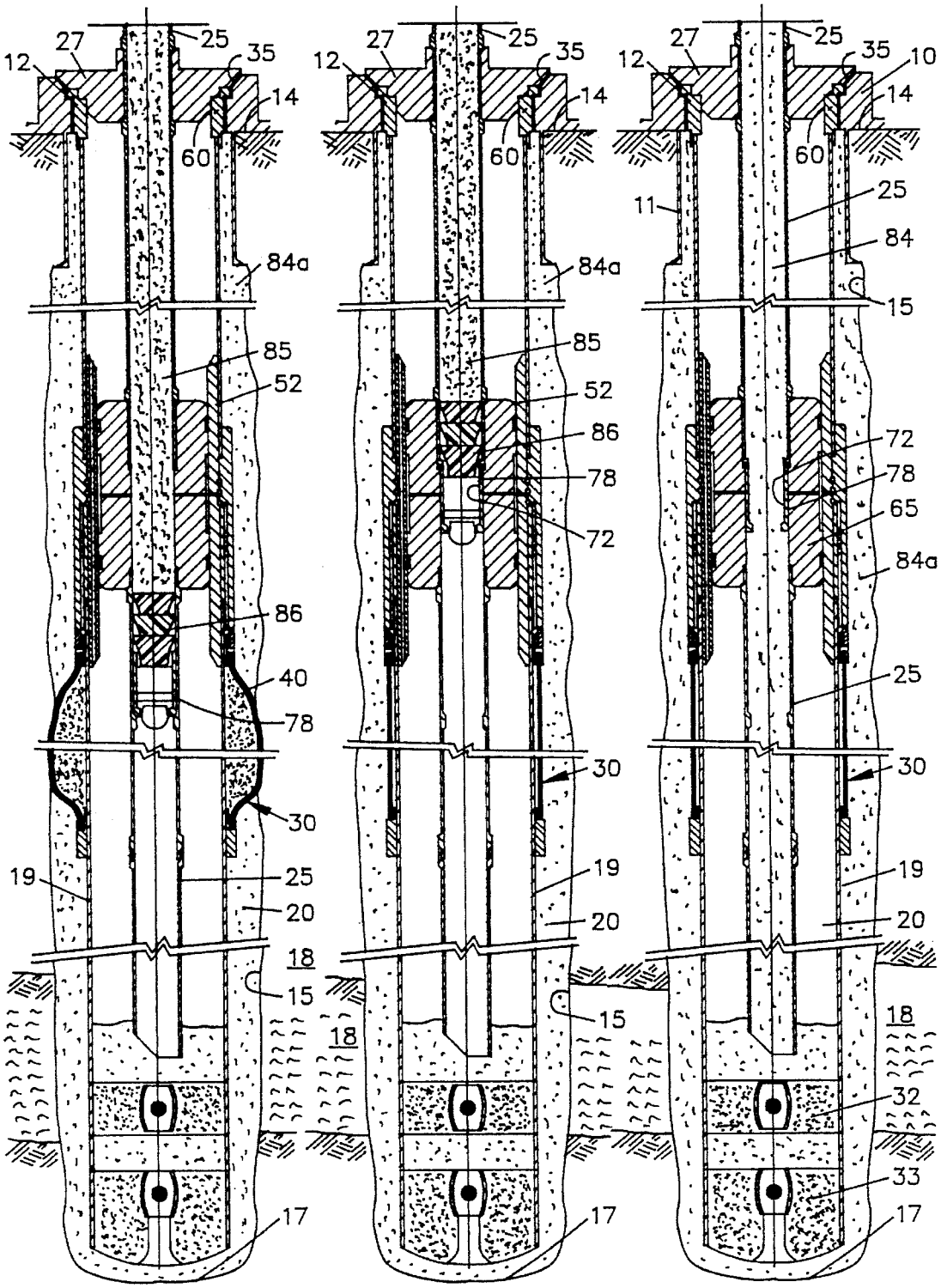
FIGS. 1, 2, and 3 are views of the invention illustrated in a subsea wellbore during primary cementing, just prior to packer inflation, and after packer inflation.

As shown in FIG. 1, a first conductor wellhead 10 with an attached conductor pipe 11 are located in a subsea template location on an ocean floor 14. A well bore 15 for the casing is then drilled thru the 36" pipe to a desired depth 17 in a conventional manner. In the process, it is not uncommon for the well bore 15 to traverse subterranean fluid flow zones 18 which contain water and/or gas which can intrude into the well bore and adversely affect the cementing of the casing.

After drilling the well bore 15, it is desired to cement a tubular, large diameter, casing 19 in place in the well bore 15 with a good cement job despite the fluid input to the annulus 20 between the casing 19 and the wellbore 15. The casing can be 26" in diameter. The casing 19 is attached to a second casing wellhead 12. The second casing wellhead 12 is releaseably coupled to a string of tubing by a running tool 27.

For ease of description, the entire assembly in its assembled position for operation, as shown in FIG. 1, will be described first.

Along the string of casing 19, in a location above the fluid input zone 18, is an external inflatable packer 30. At the lower end of the casing are float shoes and float collar or valves 32, 33. The second casing wellhead 12 sets in the first conductor wellhead 10, but has a flow passage 35 (shown by the dark line) which extends between the surfaces of the wellheads from the annulus 20 to the ocean floor 14 to permit fluid flow from the annulus 20 into the ocean. In some well heads, there is a flow passage with a remote controlled valve in the conductor wellhead.

Figure 4:
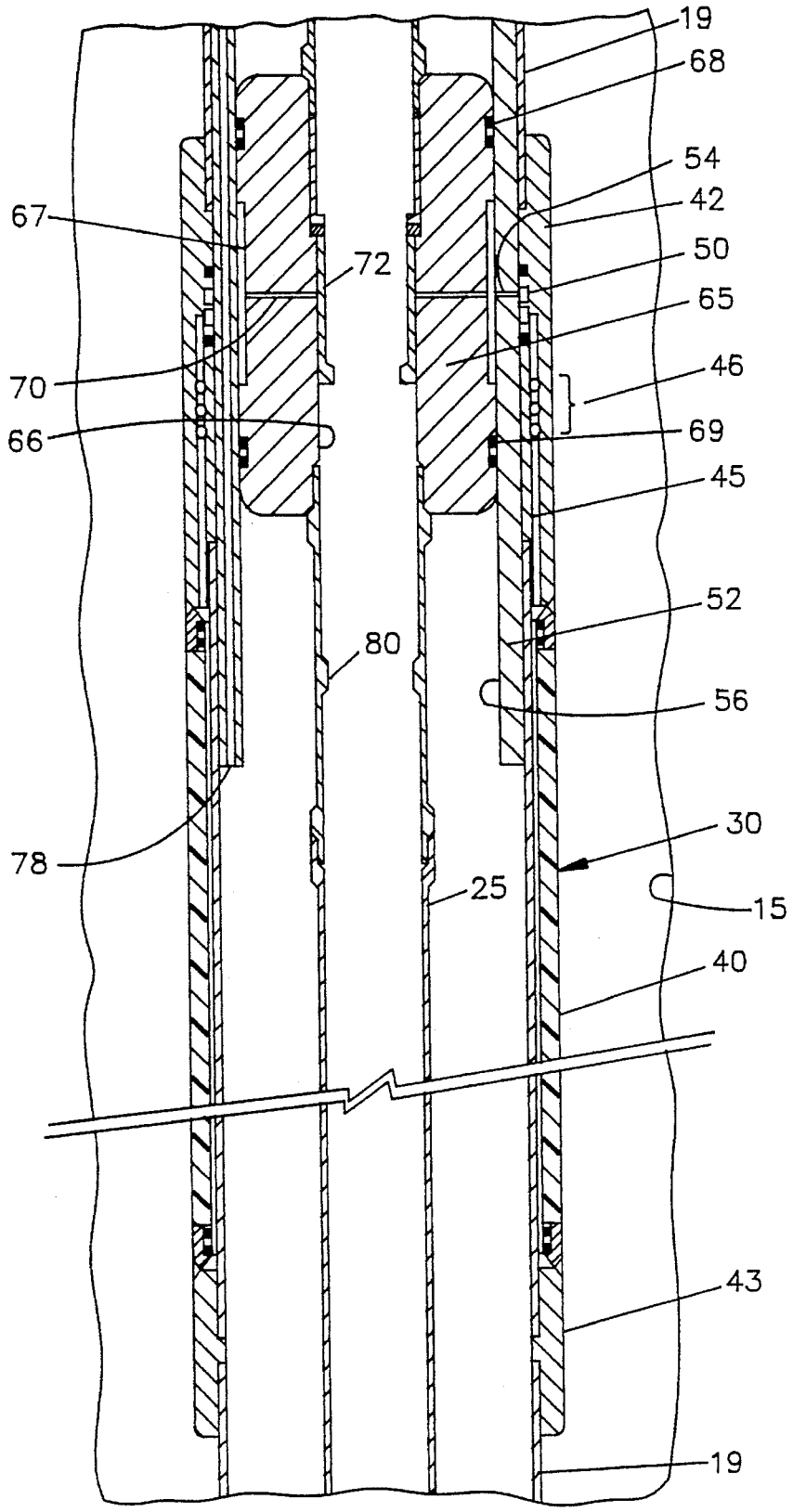
FIG. 4 is a view in partial cross-section of the inflatable packer of the present invention.
Figure 5:
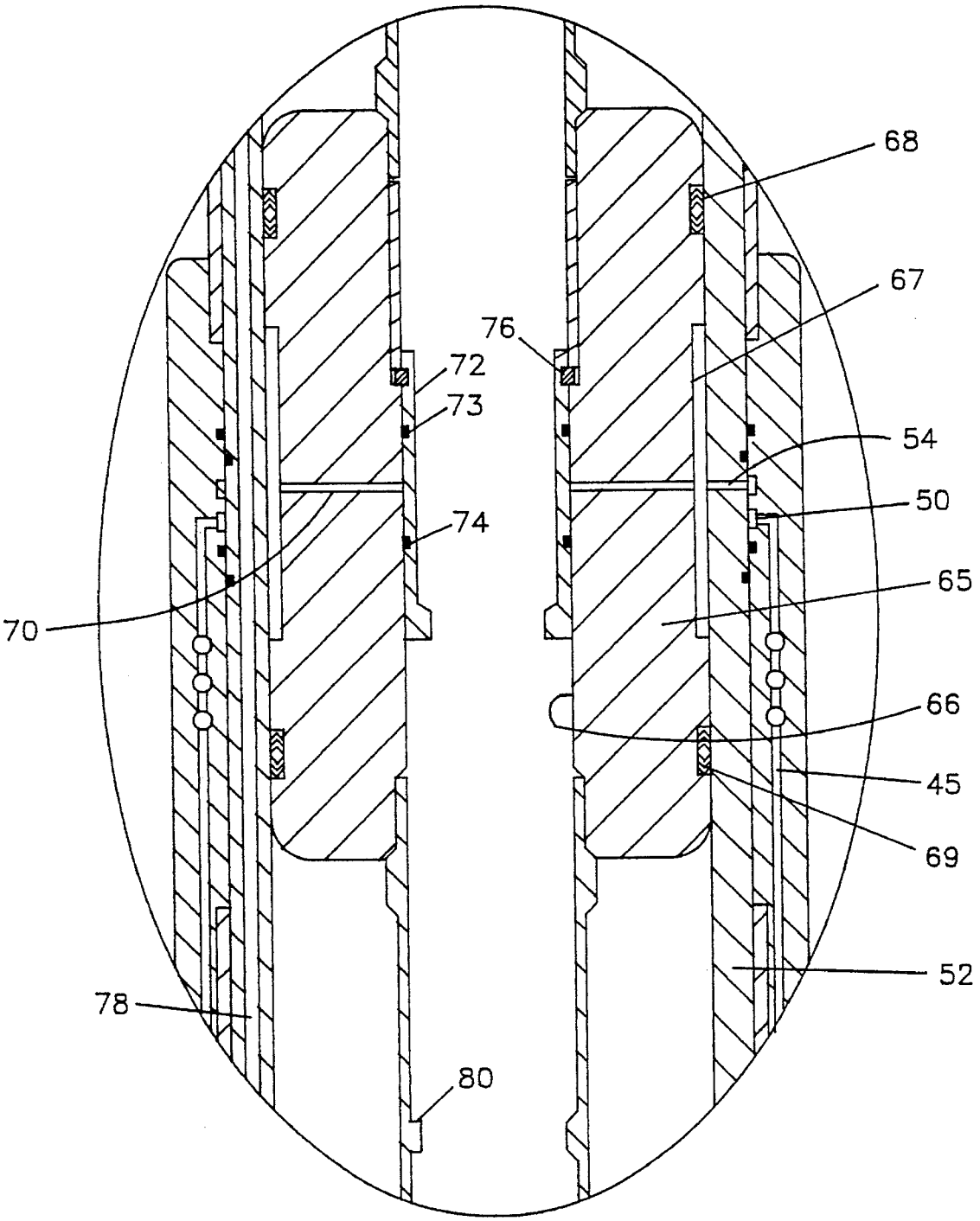
FIG. 5 is an enlarged view in cross-section through a part of the inflatable packer of the present invention.

The structure of the inflatable packer is illustrated in more detail in FIGS. 4 and 5. The packer 30 has a tubular inflatable packer element 40 which is secured to upper and lower heads 42, 43 where the heads are coupled to the casing 19. In the upper head 42 is a flow passage 45 with valve members 46 where the flow passage 45 extends between the interior of the packer element 40 and an annular recess 50 in the interior bore of the head 42. The valves 46 include a shear valve, a check valve and a limit valve (For example, see U.S. Pat. No. 4,655,286 or U.S. Pat. No. 4,402,517) which operate to open the flow passage, prevent back pressure flow, and shut off the flow at the desired inflation pressure. An inflation cement when pumped through the flow passage 45 will inflate the packer element into sealing engagement with the wall of the wellbore. An inflation packer typically can be 20 to 40 feet in length depending upon the bore size.

Disposed in the casing 19 and coextensively extended with respect to the upper head 42 is an tubular isolation sleeve or drillable insert 52. The sleeve or insert 52 is constructed of a drillable material such as aluminum and is threadedly and sealably attached to the upper head 42. The sleeve 52 has radial ports 54 extending between the annular recess 50 and the bore 56 of the isolation sleeve 52. The bore 56 of the sleeve 52 is smaller in diameter than the diameter of the bore 60 in the wellhead 12 (see FIG. 2).

The tubing string 25 is attached to the running tool 27 and has an isolation seal member 65 disposed along its length so that the isolation seal member is disposed in the bore 56 of the isolation sleeve 52. The isolation seal member 65 has an outer annular recess 67 located between sealing elements 68, 69. The annular recess 67 is connected to the bore 66 of the isolation seal member 65 for fluid flow by means of radial ports 70. In the bore 66 of the isolation seal member is tubular sleeve valve member 72 which has sealing elements 73, 74 located above and below the flow ports 70. The valve member 72 has a shear ring 76 disposed in grooves in the valve member 72 and the seal member 65. The shear ring 76 releasably retains the valve member 72 in a closed position over the ports 70. Below the valve member 72 the tubing has an interior stop shoulder or flange 80 which limits downward movement of the valve member 72 when it is shifted to an open position. As shown in the drawings, the isolation sleeve 52 has longitudinally extending bypass passages 78 which define a fluid equalization bypass about the seal member 65. If desired, the bypass can be in the body of the seal member 65.

With the above apparatus, the process involves assembling the casing 19 and tubing 25 in the positions shown in FIG. 1 and lowering the assembly with the running tool 27 and the tubing string until the casing 19 and the casing wellhead 12 are lowered into the conductor wellhead 10. The inflation ports in the inflatable packer, in the isolation member and in the seal member are prealigned but closed off by the sleeve valve member 72. At this time the inflatable packer 30 is disposed above the fluid zone 18 and is prevented from actuation by the closed sleeve member 72. The isolation seal member 65 seals off the access port 70 to the packer and the string of tubing (5½" diameter) extends to just above the float shoes 32, 33.

As shown in FIG. 2, the primary cement job is commenced and cement slurry 84 is introduced through the string of tubing 25 (slurry 84A) to the wellbore annulus 20 between the casing and the wellbore. The flow channel 35 between the wellheads 10 & 12 permit liquid (mud) to exit to the ocean and it can be determined when the cement slurry 84A begins to exit the flow channel 35. At this time, a packer inflation cement 85 is introduced behind a cementing dart 86 to the string of tubing (see FIG. 2). The inflation cement is pumped through the tubing 25 until the cementing dart 86 lands on the sleeve valve 72. Continued pressure on the inflation cement 85 causes the sleeve valve 72 to shift to an open position by shearing the shear ring 76 and stop below the isolation seal member 65 at the stop shoulder or flange 80. The packer element 40 then is inflated as shown in FIG. 3 by the inflation cement under pressure. This is accomplished before the primary cement 84A above the packer element is set up in the annulus 20 so that fluids from the zone 18 below the packer 30 are shut off with respect to the annulus 20 by the inflatable packer.

After the packer element 40 is inflated, the string of tubing 25 can be removed from the casing 19 by lifting upward. The isolation seal member is sized to pass through the restricted bore 60 of the wellhead 12.

Subsequently, the isolation sleeve 52 can be removed with an underreamer. Or, if the casing collars of the next casing size are smaller than the bore, then the sleeve 52 does not need to be underreamed.

Thus, with the present invention, an inflatable packer in a casing string attached to a wellhead can be inflated even though the bore of the casing is larger than the bore of the wellhead.

It will be apparent to those skilled in the art that various changes may be made in the invention without departing from the spirit and scope thereof and therefore the invention is not limited by that which is disclosed in the drawings and specifications but only as indicated in the appended claims.

I claim:

1. A method for primary cementing a casing in a wellbore in a subsea environment where a conductor wellhead and conductor pipe traverse subterranean earth formations and where a wellbore extends below the end of the conductor pipe and extends through a zone providing a fluid input to the wellbore, said method comprising of the steps of:

transporting a casing and a casing wellhead into the wellbore with a running tool on a string of tubing where the casing has a casing bore and the wellhead has a smaller diameter wellhead bore and where an inflatable packer is located along the length of the casing and has a packer bore complimentary to the casing bore and where an isolation sleeve is disposed in the casing bore and has a sleeve bore smaller in diameter than the wellhead bore, and where the tubing string extends to the bottom end of the casing and has a seal member disposed in the sleeve bore and where the seal bore has a normally closed valve which has access to the inflatable packer, transporting the casing into the well bore until the casing wellhead is in the conductor wellhead where the inflatable packer is located in the casing above the zone providing a fluid input;

introducing a flow of primary cement slurry through the string of tubing and into the annulus between the casing and the wellbore;

maintaining the primary flow of cement slurry until the cement slurry is positioned in the annulus above said zone;

After positioning the cement slurry, opening the closed valve and introducing an inflation cement slurry to the inflatable packer via the string of tubing to actuate the inflatable packer to close off the annulus between the wellbore and the casing and protect the primary cement slurry above said inflatable packer from the effects of said fluid input; and retrieving the seal member with the string of tubing from the casing.

2. The method as set forth in claim 1 and further including the steps of:

removing the isolation sleeve from the casing bore.

3. The method as set forth in claim 1 wherein the isolation sleeve is drillable and further including the steps of:

removing the isolation sleeve by drilling.

* * * * *